US010240812B2

(12) United States Patent
Hanazono et al.

(10) Patent No.: US 10,240,812 B2
(45) Date of Patent: Mar. 26, 2019

(54) SIGNAL PROCESSING DEVICE, PROGRAM, RANGE HOOD DEVICE, AND SELECTION METHOD FOR FREQUENCY BINS IN SIGNAL PROCESSING DEVICE

(71) Applicant: Panasonic Intellectual Property Management Co., Ltd., Osaka (JP)

(72) Inventors: Masaya Hanazono, Osaka (JP); Wakio Yamada, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 4 days.

(21) Appl. No.: 15/503,791

(22) PCT Filed: Oct. 15, 2015

(86) PCT No.: PCT/JP2015/005208
§ 371 (c)(1),
(2) Date: Feb. 14, 2017

(87) PCT Pub. No.: WO2016/067540
PCT Pub. Date: May 6, 2016

(65) Prior Publication Data

US 2017/0276398 A1 Sep. 28, 2017

(30) Foreign Application Priority Data

Oct. 28, 2014 (JP) ..... 2014-219587

(51) Int. Cl.
*F24C 15/20* (2006.01)
*G10K 11/178* (2006.01)
(Continued)

(52) U.S. Cl.
CPC ..... *F24F 13/24* (2013.01); *F24C 15/2042* (2013.01); *F24F 7/06* (2013.01);
(Continued)

(58) Field of Classification Search
CPC ..... F24F 13/24; F24F 2013/247; F24F 7/06; F24C 15/2042; G10K 11/178;
(Continued)

(56) References Cited

U.S. PATENT DOCUMENTS

2009/0279710 A1 11/2009 Onishi et al.
2013/0279712 A1 10/2013 Nohara et al.

FOREIGN PATENT DOCUMENTS

JP 04-282695 10/1992
JP 07-219563 8/1995
(Continued)

OTHER PUBLICATIONS

International Search Report for corresponding International Application No. PCT/JP2015/005208 dated Dec. 8, 2015.
(Continued)

*Primary Examiner* — Paul Kim
*Assistant Examiner* — Douglas J Suthers
(74) *Attorney, Agent, or Firm* — Renner, Otto, Boisselle & Sklar, LLP

(57) ABSTRACT

Provided are a signal processing device, a program, a range hood device, and a selection method for frequency bins in a signal processing device with which it is possible to reduce the load on computation processing for computing filter coefficients and provide an excellent muting effect even when there are a peak band and a notch band in transmission characteristics from a speaker to an error microphone. A parameter setter sets an update parameter μ such that a filter coefficient W is corrected, only for a first frequency bin that corresponds to a frequency band of a first noise and a second frequency bin that corresponds to a frequency band of a second noise.

8 Claims, 12 Drawing Sheets

(51) Int. Cl.
*H04R 1/02* (2006.01)
*F24F 13/24* (2006.01)
*F24F 7/06* (2006.01)

(52) U.S. Cl.
CPC ..... *G10K 11/178* (2013.01); *G10K 11/17854* (2018.01); *G10K 11/17881* (2018.01); *F24F 2013/247* (2013.01); *G10K 2210/105* (2013.01); *G10K 2210/109* (2013.01); *G10K 2210/3025* (2013.01); *G10K 2210/3028* (2013.01); *G10K 2210/3055* (2013.01)

(58) Field of Classification Search
CPC ..... G10K 11/1782; G10K 2210/105; G10K 2210/3028; G10K 11/17881; G10K 11/17854; G10K 2210/109; G10K 2210/3025; G10K 2210/3055
USPC ..... 381/71.3, 71.11, 71.12
See application file for complete search history.

(56) References Cited

FOREIGN PATENT DOCUMENTS

| | | |
|---|---|---|
| JP | 2012-168283 | 9/2012 |
| JP | 2013-071535 | 4/2013 |
| WO | WO 2007/011010 A1 | 1/2007 |
| WO | WO 2012/093477 A1 | 7/2012 |

OTHER PUBLICATIONS

Form PCT/ISA/237 for corresponding International Application No. PCT/JP2015/005208 dated Dec. 8, 2015.

TRANSMISSION CHARACTERISTICS C

TRANSMISSION CHARACTERISTICS C

SIGNAL PROCESSING DEVICE, PROGRAM, RANGE HOOD DEVICE, AND SELECTION METHOD FOR FREQUENCY BINS IN SIGNAL PROCESSING DEVICE

TECHNICAL FIELD

The present invention generally relates to a signal processing device, a program, a range hood device, and a selection method for frequency bins in a signal processing device, and more specifically to a signal processing device, a program, a range hood device, and a selection method for frequency bins in a signal processing device that are for performing active noise control.

BACKGROUND ART

Conventionally, as a technique for reducing noise in a space (noise propagation path) through which noise emitted from a noise source propagates, there is a muting device that uses active noise control. The active noise control is a technique for actively reducing noise by emitting a canceling sound with opposite phase and the same amplitude with respect to the noise.

Conventional techniques (see, for example, Patent Literatures (PTLs) 1 and 2) disclose a configuration in which a canceling sound is generated by updating filter coefficients in an adaptive digital filter by using a least mean square (LMS) algorithm. The LMS algorithm computes a filter coefficient by using an update parameter (step size parameter: a parameter that defines the magnitude of the amount of correction in every repetition).

CITATION LIST

Patent Literature

PTL 1: Japanese Unexamined Patent Application Publication No. H7-219563
PTL 2: WO 2007/011010

SUMMARY OF THE INVENTION

Technical Problems

Because the conventional techniques require a heavy load on computation processing for computing filter coefficients, there is demand to reduce the computation load.

In addition, in the transmission characteristics from a speaker to an error microphone, there are a peak band in which the gain increases and a notch band in which the gain drops, which negatively affects the muting effect. Accordingly, there is demand for active noise control that can provide an excellent muting effect even when there are a notch band and a peak band in the transmission characteristics from a speaker to an error microphone.

The present invention has been made in view of the above-described circumstances, and it is an object of the present invention to provide a signal processing device, a program, a range hood device, and a selection method for frequency bins in a signal processing device with which it is possible to reduce the load on computation processing for computing filter coefficients and provide an excellent muting effect even when there are a peak band and a notch band in the transmission characteristics from a speaker to an error microphone.

Solutions to Problems

A signal processing device according to the present invention is used in combination with a sound input/output device including a first sound inputter that is provided in a space through which a first noise emitted from a noise source propagates and that collects the first noise, a sound outputter that receives an input of a canceling signal and that outputs, to the space, a canceling sound that cancels out the first noise, and a second sound inputter that collects, in the space, a combined sound of the first noise and the canceling sound. The signal processing device includes: a canceling signal generator including a muting filter in which a filter coefficient is set for each of a plurality of frequency bins obtained by dividing a predetermined frequency band, the canceling signal generator receiving an input of a noise signal generated based on an output of the first sound inputter and outputting the canceling signal; a coefficient updater that calculates the filter coefficient for each of the plurality of frequency bins based on an output of the first sound inputter, an output of the second sound inputter, and an update parameter that is related to a magnitude of an amount of correction for the filter coefficient in processing of repeatedly calculating the filter coefficient; and a parameter setter that sets the update parameter for each of the plurality of frequency bins. In the signal processing device, with respect to a first frequency bin and a second frequency bin among the plurality of frequency bins, the first frequency bin corresponding to a frequency band of the first noise, and the second frequency bin corresponding to a frequency band of a second noise that is different from the first noise, the parameter setter sets the update parameter such that the filter coefficient is corrected, and with respect to a third frequency bin among frequency bins that do not correspond to any of the frequency band of the first noise and the frequency band of the second noise among the plurality of frequency bins, the third frequency bin constituting a notch band in which transmission characteristics in an acoustic path extending from the sound outputter to the second sound inputter drop, the parameter setter sets the update parameter such that the filter coefficient is not corrected.

A program according to the present invention causes a computer to function as the signal processing device.

A range hood device according to the present invention includes: an air flow path that is hollow; a fan that generates a flow of air flowing from one end of the air flow path to another end of the air flow path; a first sound inputter that is provided within the air flow path and that collects a first noise emitted by the fan; a sound outputter that receives an input of a canceling signal and outputs, into the air flow path, a canceling sound that cancels out the first noise; a second sound inputter that collects, within the air flow path, a combined sound of the first noise and the canceling sound; and the signal processing device according to any one of claims 1 to 3. In the range hood device, the second sound inputter, the sound outputter, and the first sound inputter are disposed in this order in a direction from the one end of the air flow path to the other end of the air flow path.

A selection method for frequency bins in a signal processing device according to the present invention is a selection method for frequency bins in the signal processing device, the method including: setting, as the second frequency bin, a frequency bin among frequency bins that do not correspond to a frequency band of the first noise emitted from the noise source, the frequency bin being where a gain of the filter coefficient when the update parameter with which the filter coefficient is not corrected is set is greater than a gain of the filter coefficient when the update parameter with which the filter coefficient is corrected is set; and setting, as the third frequency bin, a frequency bin among the frequency bins that do not correspond to the frequency band of the first noise, the frequency bin being where an amount of group delay of transmission characteristics in the acoustic path extending from the sound outputter to the second sound inputter falls below a threshold value.

Advantageous Effects of Invention

A signal processing device, a program, a range hood device, and a selection method for frequency bins in a signal processing device according to the present invention have an advantageous effect of reducing the load on computation processing for computing filter coefficients. Furthermore, the signal processing device, the program, the range hood device, and the selection method for frequency bins in a signal processing device according to the present invention have an advantageous effect of providing an excellent muting effect even when there are a notch band and a peak band in the transmission characteristics from a speaker to an error microphone.

DESCRIPTION OF EXEMPLARY EMBODIMENTS

Hereinafter, embodiments of the present invention will be described with reference to the drawings.

Note that the embodiments described below show preferred specific examples of the present invention. The numerical values, shapes, materials, structural elements, the arrangement and connection of the structural elements, steps, the order of the steps, and the like shown in the following embodiments are merely examples, and therefore are not intended to limit the scope of the present invention. The present invention is defined by the appended claims. Accordingly, among the structural elements described in the following embodiments, structural elements that are not recited in any one of the independent claims are described as arbitrary structural elements.

Embodiment 1

Figure 1:
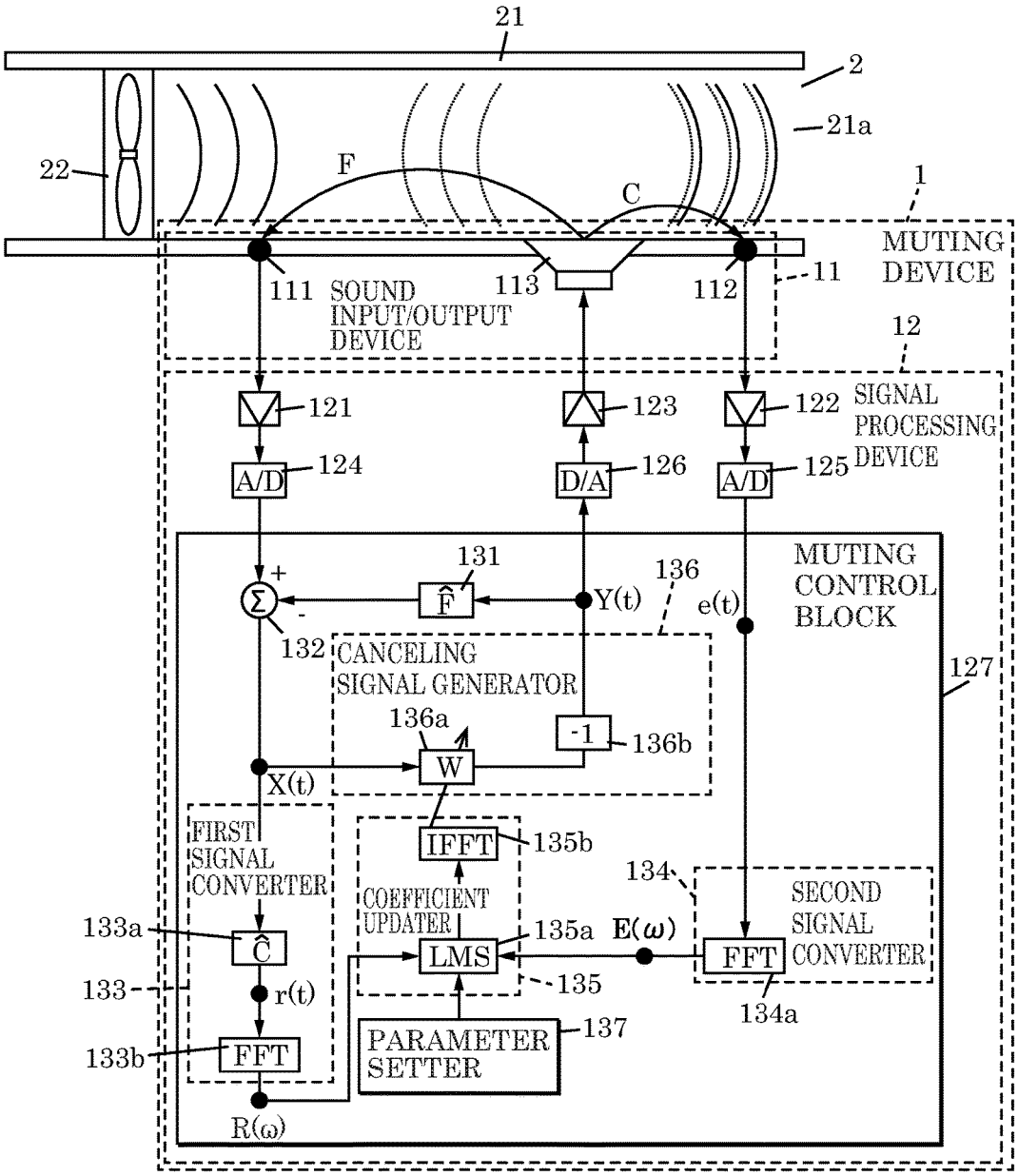
FIG. 1 is a block diagram showing a configuration according to Embodiment 1.

FIG. 1 shows a configuration of muting device 1 (active noise control device) according to the present embodiment, and range hood device 2 includes muting device 1.

Figure 2:
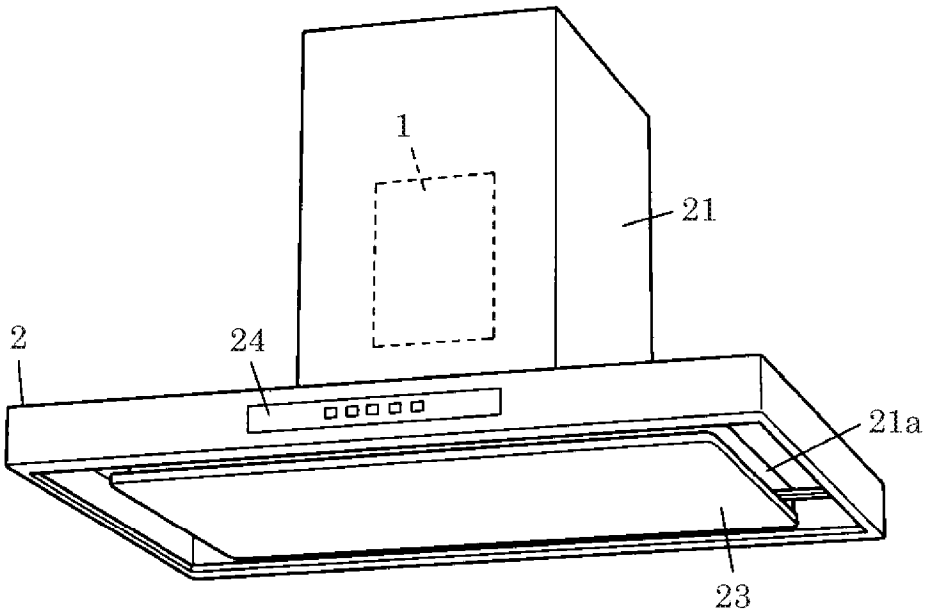
FIG. 2 is a perspective view showing an outer appearance of a range hood device according to Embodiment 1.

As shown in FIG. 2, range hood device 2 includes duct 21 (air flow path) that is provided above cooking equipment in kitchen. Duct 21 is formed in a box shape having air inlet 21*a* on the underside. Duct 21 includes fan 22 (see FIG. 1) that takes in room air from air inlet 21*a* into duct 21 and discharges the intake air to the outside. Also, baffle plate 23 is attached to air inlet 21*a*. Baffle plate 23 is configured to be smaller than air inlet 21*a* so as to improve air-intake efficiency. Also, operator 24 is attached to the front surface of range hood device 2, and operator 24 includes operation switches for performing various operations of range hood device 2, an indication light that indicates the operating state of range hood device 2, and the like. The space within duct 21 constituting an air flow path corresponds to the space through which noise propagates.

Upon operation of fan 22, fan 22 acts as a noise source, and an operating sound (first noise) of fan 22 propagates through duct 21 and is transferred through air inlet 21*a* into the room. In order to suppress the noise transferred into the room during operation of fan 22, muting device 1 is provided in duct 21.

As shown in FIG. 1, muting device 1 provided in duct 21 includes sound input/output device 11 and signal processing device 12.

Sound input/output device 11 includes reference microphone 111 (first sound inputter), error microphone 112 (second sound inputter) and speaker (sound outputter) 113. Reference microphone 111 is positioned at the side of fan 22 within duct 21. Error microphone 112 is positioned at the side of air inlet 21*a* within duct 21. Speaker 113 is positioned between reference microphone 111 and error microphone 112 within duct 21. That is, reference microphone 111, speaker 113 and error microphone 112 are disposed in this order in a direction from fan 22 to air inlet 21*a*.

Signal processing device 12 includes amplifiers 121, 122 and 123, A/D converters 124 and 125, D/A converter 126, and muting control block 127.

An output of reference microphone 111 is amplified by amplifier 121 and then A/D converted by A/D converter 124. An output of A/D converter 124 is input into muting control block 127.

An output of error microphone 112 is amplified by amplifier 122 and then A/D converted by A/D converter 125. An output of A/D converter 125 is input into muting control block 127.

A canceling signal output from muting control block 127 is D/A converted by D/A converter 126 and then amplified by amplifier 123. Speaker 113 receives an input of the canceling signal amplified by amplifier 123 and outputs a canceling sound.

Muting control block 127 is implemented by a computer that executes a program. Muting control block 127 causes the canceling sound that cancels out the first noise emitted by fan 22 to be output from speaker 113 so as to minimize the sound pressure level at the installation point (muting point) of error microphone 112. That is, as a result of speaker 113 outputting the canceling sound, the first noise transferred from fan 22 to the outside of duct 21 through air inlet 21*a* is suppressed. Muting control block 127 performs active noise control and executes a muting program that implements an adaptive filter function in order to follow changes in the noise of fan 22 that acts as a noise source as well as changes in the noise propagation characteristics. To update filter coefficients in the adaptive filter, a filtered-X LMS (Least Mean Square) sequential update control algorithm is used.

Hereinafter, operations performed by signal processing device 12 will be described.

First, reference microphone 111 collects the first noise which is the noise from fan 22 and outputs a noise signal including the collected first noise to signal processing device 12. A/D converter 124 outputs a discrete value to muting control block 127, the discrete value being obtained by A/D converting the noise signal amplified by amplifier 121 at a predetermined sampling frequency.

Error microphone 112 collects the remaining noise which was not cancelled out by the canceling sound at the muting point and outputs an error signal corresponding to the collected remaining noise to signal processing device 12. A/D converter 125 A/D outputs a discrete value to muting control block 127 as time-domain error signal e(t), the discrete value being obtained by A/D converting an error signal amplified by amplifier 122 at the same sampling frequency as that used by A/D converter 124.

Muting control block 127 includes howling cancel filter 131, subtracter 132, first signal converter 133, second signal converter 134, coefficient updater 135, canceling signal generator 136, and parameter setter 137. First signal converter 133 includes correction filter 133*a*, and converter 133*b*. Second signal converter 134 includes converter 134*a*. Coefficient updater 135 includes coefficient adjuster 135*a*, and inverse transformer 135*b*. Canceling signal generator 136 includes muting filter 136*a*, and inverter 136*b*.

Howling cancel filter 131 is a finite impulse response filter (FIR) filter in which transmission characteristics F^ that mimic transmission characteristics F of sound waves traveling from speaker 113 to reference microphone 111 are set as filter coefficients. The transmission characteristics that mimic transmission characteristics F are represented by F^ which is a reference symbol obtained by adding a circumflex ^ (hat symbol) to the letter F. Although the symbol ^ is provided obliquely above the letter F in this specification, and the symbol ^ is provided immediately above the letter F in FIGS. 1, 9 and 11, they represent transmission characteristics that mimic transmission characteristics F.

Howling cancel filter 131 convolutes transmission characteristics F^ with canceling signal Y(t) output by canceling signal generator 136. Then, subtracter 132 outputs a signal obtained by subtracting an output of howling cancel filter 131 from the output of A/D converter 124. That is, a signal obtained by subtracting a sneaking component of the canceling sound from the noise signal collected by reference microphone 111 is output from subtracter 132 as noise signal X(t). Accordingly, even if the canceling sound output by speaker 113 sneaks into reference microphone 111, it is possible to prevent the occurrence of howling. An output of subtracter 132 is input into muting filter 136*a* and correction filter 133*a*.

Muting filter 136*a* is an FIR adaptive filter in which filter coefficient W(t) is set by coefficient updater 135. In muting filter 136*a* according to the present embodiment, filter coefficients W1(*t*) to Wn(t) are respectively set for a plurality of frequency bins obtained by dividing the whole frequency band of the canceling sound into n regions. In this specification, where it is unnecessary to make a distinction between time-domain filter coefficients W1(*t*) to Wn(t), they are represented by filter coefficient W(t). Also, the number of frequency bins is set such that the frequency width of the frequency bins is, for example, several tens to several hundreds Hz.

Correction filter 133*a* is an FIR filter in which transmission characteristics C^ that mimic transmission characteristics C of sound waves traveling from speaker 113 to error microphone 112 are set as filter coefficients. Then, correction filter 133*a* performs convolution between noise signal X(t) output by subtracter 132 and transmission characteristics C^, and an output of correction filter 133*a* is input into converter 133*b* as time-domain reference signal r(t). Converter 133*b* converts time-domain reference signal r(t) to frequency-domain reference signal R(ω) by fast fourier transform (FFT). That is, first signal converter 133 outputs, to coefficient adjuster 135*a*, frequency-domain reference signal R(ω) obtained by correcting noise signal X(t) based on transmission characteristics C^.

Also, converter 134*a* in second signal converter 134 converts time-domain error signal e(t) to frequency-domain error signal E(ω) by FFT. That is, second signal converter 134 outputs frequency-domain error signal E(ω) to coefficient adjuster 135*a*.

Coefficient adjuster 135*a* in coefficient updater 135 updates filter coefficients W1(ω) to Wn(ω) in muting filter 136*a* by using a known sequential update control algorithm such as a filtered-X LMS algorithm in the frequency domain. Coefficient adjuster 135*a* receives an input of reference signal R(ω) and error signal E(ω). Furthermore, update parameter μ is set by parameter setter 137, and filter coefficients W1(ω) to Wn(ω) in muting filter 136*a* are computed. In this specification, where it is unnecessary to make a distinction between frequency-domain filter coefficients W1(ω) to Wn(ω), they are represented by filter coefficient W(ω). Furthermore, where it is unnecessary to make a distinction between time-domain filter coefficient W(t) and frequency-domain filter coefficient W(ω), they are represented by filter coefficient W.

In general, in update processing of updating filter coefficient W(ω) by using a frequency-domain filtered-X LMS algorithm, filter coefficient W(ω) is updated such that error signal E(ω) is minimized. To be specific, the filter coefficient W(ω) update processing is represented by Equation 1 given below, where the filter coefficient is represented by W(ω), the update parameter is represented by μ, and the sample number is represented by m. Update parameter μ is a parameter that is also called step size parameter, and that defines the magnitude of the amount of correction for filter coefficient W(ω) in processing of repeatedly calculating filter coefficient W(ω) by using an LMS algorithm or the like.

$$W_{m+1}(\omega)=W_m(\omega)+2\mu R_m(\omega)E_m(\omega) \quad \text{(Equation 1)}$$

In Equation 1 given above, if the second term of the right side which includes reference signal R(ω), error signal E(ω) and update parameter m increases, the least square error is reached even rapidly, and filter coefficient W(ω) converges even rapidly. That is, the convergence time of filter coefficient W(ω) is dependent on the magnitude of reference signal R(ω), error signal E(ω) and update parameter μ.

For example, if the amplitude of each of reference signal R(ω) and error signal E(ω) is large, filter coefficient W(ω)

converges rapidly. If the amplitude of each of reference signal R(ω) and error signal E(ω) is small, it takes time for filter coefficient W(ω) to converge. Accordingly, coefficient adjuster 135*a* adjusts the convergence time by performing multiplication with update parameter μ during the computation processing of computing filter coefficient W(ω). In order to shorten the time required for the convergence, it is necessary to increase update parameter μ. However, if update parameter μ is too large, the filter coefficient may diverge instead of converging.

Accordingly, parameter setter 137 adjusts the convergence speeds of filter coefficients W1(ω) to Wn(ω) on a per-frequency-bin basis by setting update parameters μ1 to μn that respectively correspond to the plurality of frequency bins. Parameter setter 137 passes each value of update parameters μ1 to μn to coefficient adjuster 135*a*. In this specification, where it is unnecessary to make a distinction between update parameters μ1 to μn, they are represented by update parameter μ.

That is, coefficient adjuster 135*a* receives an input of frequency-domain reference signal R(ω) and frequency-domain error signal E(ω), and update parameters μ1 to μn used by the LMS algorithm for each frequency bin are set by parameter setter 137. Then, coefficient adjuster 135*a* executes a filtered-X LMS algorithm in the frequency domain (see Equation 1) so as to calculate filter coefficients W1(ω) to Wn(ω) for each frequency bin and outputs filter coefficients W1(ω) to Wn(ω). Accordingly, signal processing device 12 can implement highly accurate filter characteristics by setting filter coefficients W1(ω) to Wn(ω) on a per-frequency-bin basis.

Inverse transformer 135*b* converts frequency-domain filter coefficients W1(ω) to Wn(ω) calculated by coefficient adjuster 135*a* to time-domain filter coefficients W1(*t*) to Wn(t) by executing inverse fast fourier transform (inverse FFT). Filter coefficients W1(*t*) to Wn(t) for each frequency bin in muting filter 136*a* are set by the output of inverse transformer 135*b*.

Then, coefficient updater 135 sequentially updates filter coefficients W1(*t*) to Wn(t) in muting filter 136*a*. Muting filter 136*a* separates noise signal X(t) on a per-frequency-bin basis, and performs convolution between noise signal X(t) and filter coefficients W1(*t*) to Wn(t) on a per-frequency-bin basis. Then, muting filter 136*a* outputs a sum of the results of convolution performed on a per-frequency-bin basis. Then, an output of muting filter 136*a* is phase inverted by inverter 136*b* so as to generate canceling signal Y(t). Canceling signal Y(t) output by canceling signal generator 136 is D/A converted by D/A converter 126 and thereafter amplified by amplifier 123, and a canceling sound is output from speaker 113.

The canceling sound (canceling signal Y(t)) is generated such that its waveform has opposite phase and the same amplitude with respect to the waveform of noise at the muting point, so as to reduce the first noise that propagates from fan 22 to duct 21 and is discharged from air inlet 21*a*.

Figure 3:
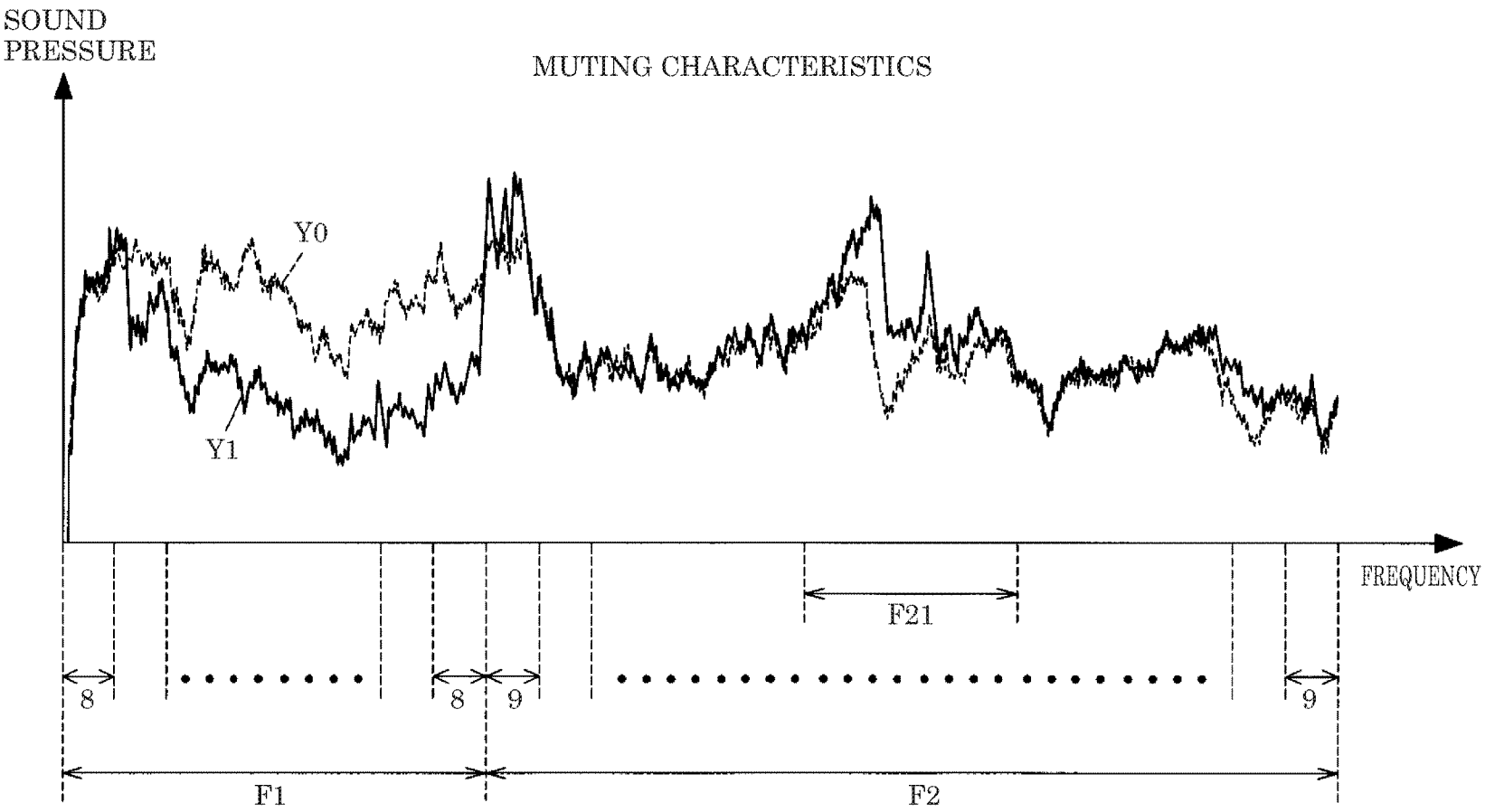
FIG. 3 is a graph showing muting characteristics obtained when partial update processing has been performed according to Embodiment 1.

Here, as shown in FIG. 3, if the frequency band of the first noise emitted by fan 22 is F1 that is on a low frequency side, with respect to frequency bins 8 (first frequency bin) constituting frequency band F1, the filter coefficient W (ω) update processing by coefficient adjuster 135*a* is performed. Furthermore, with respect to frequency bins 9 constituting frequency band F2 (a frequency band on a high frequency side shown in FIG. 3) other than first noise frequency band F1, the filter coefficient W (ω) update processing by coefficient adjuster 135*a* is not performed. Hereinafter, processing in which the filter coefficient W (ω) update processing is performed only on a partial frequency band will be referred to as partial update processing. In the partial update processing, with respect to frequency bins 8 constituting frequency band F1, parameter setter 137 sets update parameter μ to a value greater than zero and causes coefficient adjuster 135*a* to execute the filter coefficient W (ω) update processing. Also, with respect to frequency bins 9 constituting frequency band F2, parameter setter 137 sets update parameter μ to zero and does not cause coefficient adjuster 135*a* to execute the filter coefficient W (ω) update processing.

FIG. 3 shows muting characteristics in which characteristics Y1 (solid line) indicate the sound pressure (amplitude) at the muting point when the partial update processing described above has been performed. Characteristics Y0 (broken line) indicate the sound pressure (amplitude) at the muting point when noise suppression processing by muting device 1 is not performed. With characteristics Y1, the amount of noise reduction in frequency band F1 is large, but in frequency band F2, there is frequency band F21 in which the sound pressure is locally amplified.

Frequency band F21 corresponds to a frequency band in which the gain of transmission characteristics C reaches a peak, and frequency band F21 will be hereinafter referred to as peak band F21 (see (a) in FIG. 4). In peak band F21, the filter coefficient W (ω) update processing by coefficient adjuster 135*a* is not performed, and thus the gain of filter coefficient W(ω) tends to be large. Thus, the muting characteristics are as shown by characteristics Y1 in which the sound pressure is locally increased in peak band F21.

Figure 5:
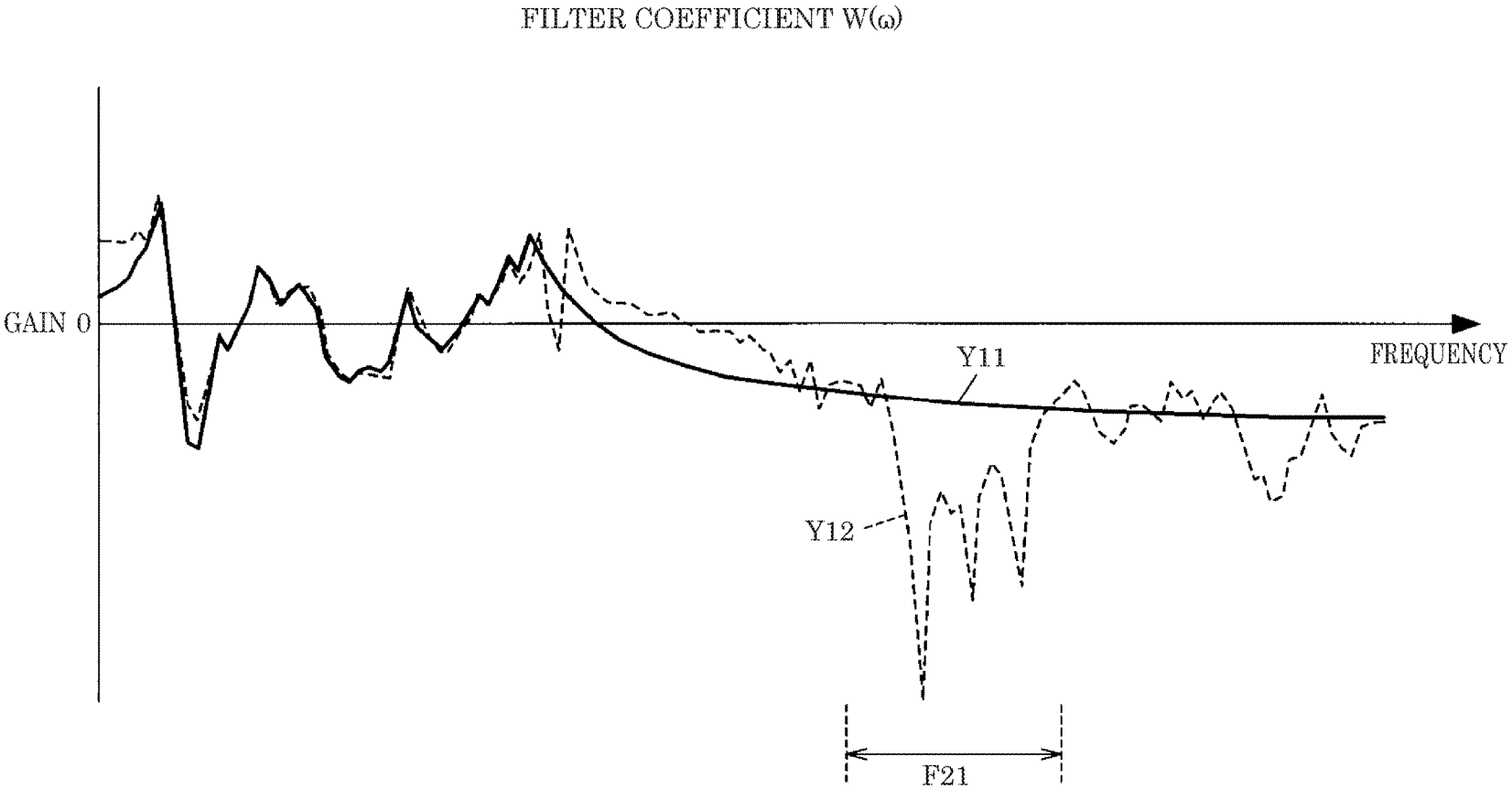
FIG. 5 is a graph showing an example of filter coefficients according to Embodiment 1.

FIG. 5 shows characteristics (filter characteristics) of filter coefficient W(ω). If the partial update processing is performed, filter characteristics Y11 (solid line) are obtained. Also, if full update processing is performed, the full update processing being processing in which the filter coefficient W (ω) update processing is performed in the whole frequency band (in both of frequency bands F1 and F2), filter characteristics Y12 (broken line) are obtained. With filter characteristics Y11, the gain takes a relatively high value in peak band F21 because the filter coefficient W (ω) update processing was not performed in peak band F21. With filter characteristics Y12, the gain in peak band F21 is optimized because the filter coefficient W (ω) update processing was performed in peak band F21. That is, in peak band F21, the gain of filter characteristics Y11 is larger than the gain of filter characteristics Y12. The canceling sound output from speaker 113 is generated by convolution between noise signal X(t) and filter coefficient W(t) (the result obtained by performing inverse FFT on filter coefficient W(ω)), and thus the canceling sound is locally amplified in frequency band F21. Accordingly, with the muting characteristics, as shown by characteristics Y1 in FIG. 3, peak band F21 in which the sound pressure is locally amplified has occurred in frequency band F2. The canceling sound locally amplified in peak band F21 is a second noise.

Figure 6:
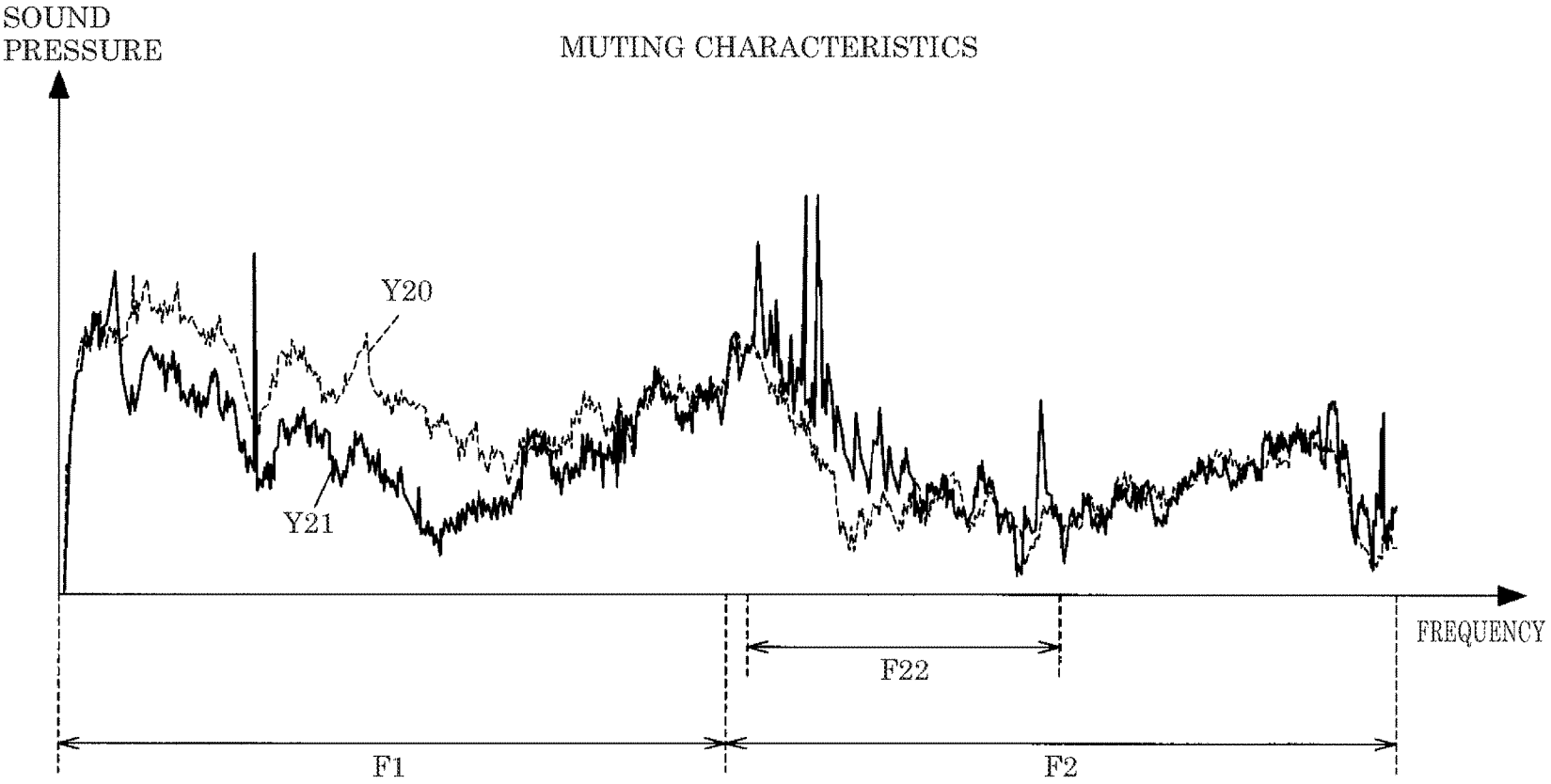
FIG. 6 is a graph showing muting characteristics obtained when full update processing has been performed according to Embodiment 1.

Next, muting characteristics obtained when the full update processing has been performed are shown in FIG. 6. In FIG. 6, characteristics Y21 (solid line) indicate the sound pressure (amplitude) at the muting point when the full update processing was performed. Also, characteristics Y20 (broken line) indicate the sound pressure (amplitude) at the muting point when noise suppression processing by muting device 1 was not performed. With characteristics Y21, frequency band F22 in which the pressure sound is locally amplified and oscillated has occurred in frequency band F2.

Frequency band F22 corresponds to a frequency band in which the gain of transmission characteristics C locally drops, and frequency band F22 will be hereinafter referred to as notch band F22 (see (a) in FIG. 4). In notch band F22, with transmission characteristics C, the gain is low, and the phase varies significantly, and thus a characteristics error between transmission characteristics C^ set in correction filter 133*a* and actual transmission characteristics C is likely to occur, and amplification and oscillation are produced as with characteristics Y21. (b) in FIG. 4 shows group delay characteristics of transmission characteristics C (the differential characteristics of the phase component), from which it can be seen that the phase varies significantly in notch band F22 and the amount of group delay in notch band F22 is large. In the present embodiment, a frequency band in which the amount of group delay of transmission characteristics C falls below threshold value D1 (for example, D1=0) is set as notch band F22. Threshold value D1 may be set to a value other than 0, and the value of threshold value D1 is set as appropriate.

Accordingly, signal processing device 12 performs the following processing in order to suppress amplification in peak band F21 described above and to not produce amplification and oscillation in notch band F22.

Figure 7:
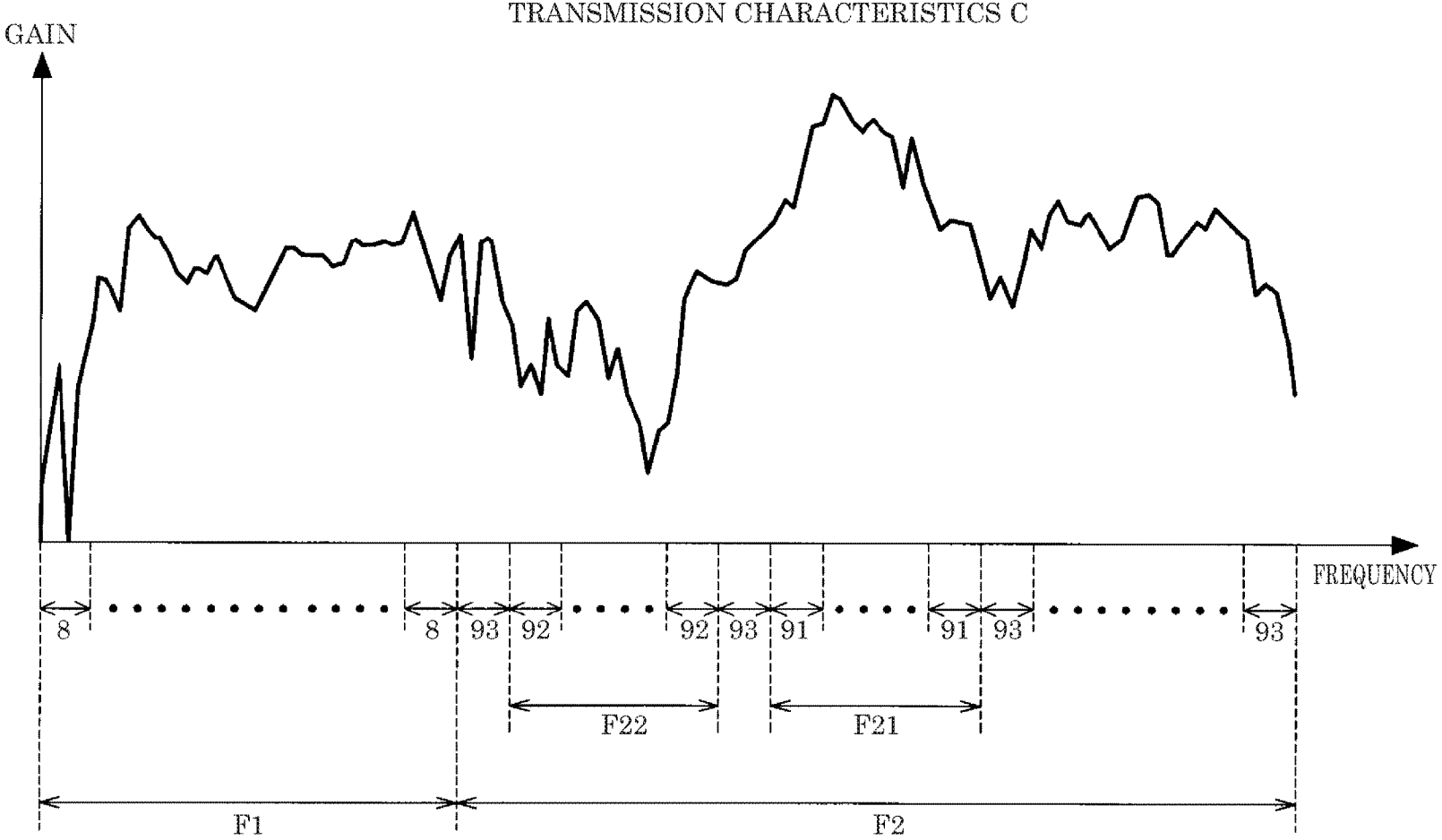
FIG. 7 is an illustrative diagram showing processing performed by a signal processing device according to Embodiment 1.

Parameter setter 137 sets update parameter μ to a value greater than zero with respect to frequency bins 8 (first frequency bin) constituting first noise frequency band F1 that is the frequency band of the first noise emitted by fan 22 as shown in FIG. 7.

Parameter setter 137 sets update parameter μ to a value greater than zero with respect to frequency bins 91 (second frequency bin) constituting peak band F21 within frequency band F2 as shown in FIG. 7.

Parameter setter 137 consistently sets update parameter μ to zero with respect to frequency bins 92 (third frequency bin) constituting notch band F22 as shown in FIG. 7 among frequency bins 9 constituting a band other than peak band F21 within frequency band F2.

In addition, parameter setter 137 also sets update parameter μ to zero with respect to frequency bins 93 that do not constitute notch band F22 as shown in FIG. 7 among frequency bins 9 constituting a band other than peak band F21 within frequency band F2. In the present embodiment, update parameter μ for frequency bins 93 is set to zero, but update parameter μ for frequency bins 93 may be set to a value greater than zero. That is, it is sufficient that update parameter μ is consistently set to zero with respect to frequency bins 92 constituting notch band F22 among frequency bins 9 constituting a band other than peak band F21 within frequency band F2.

Figure 4:
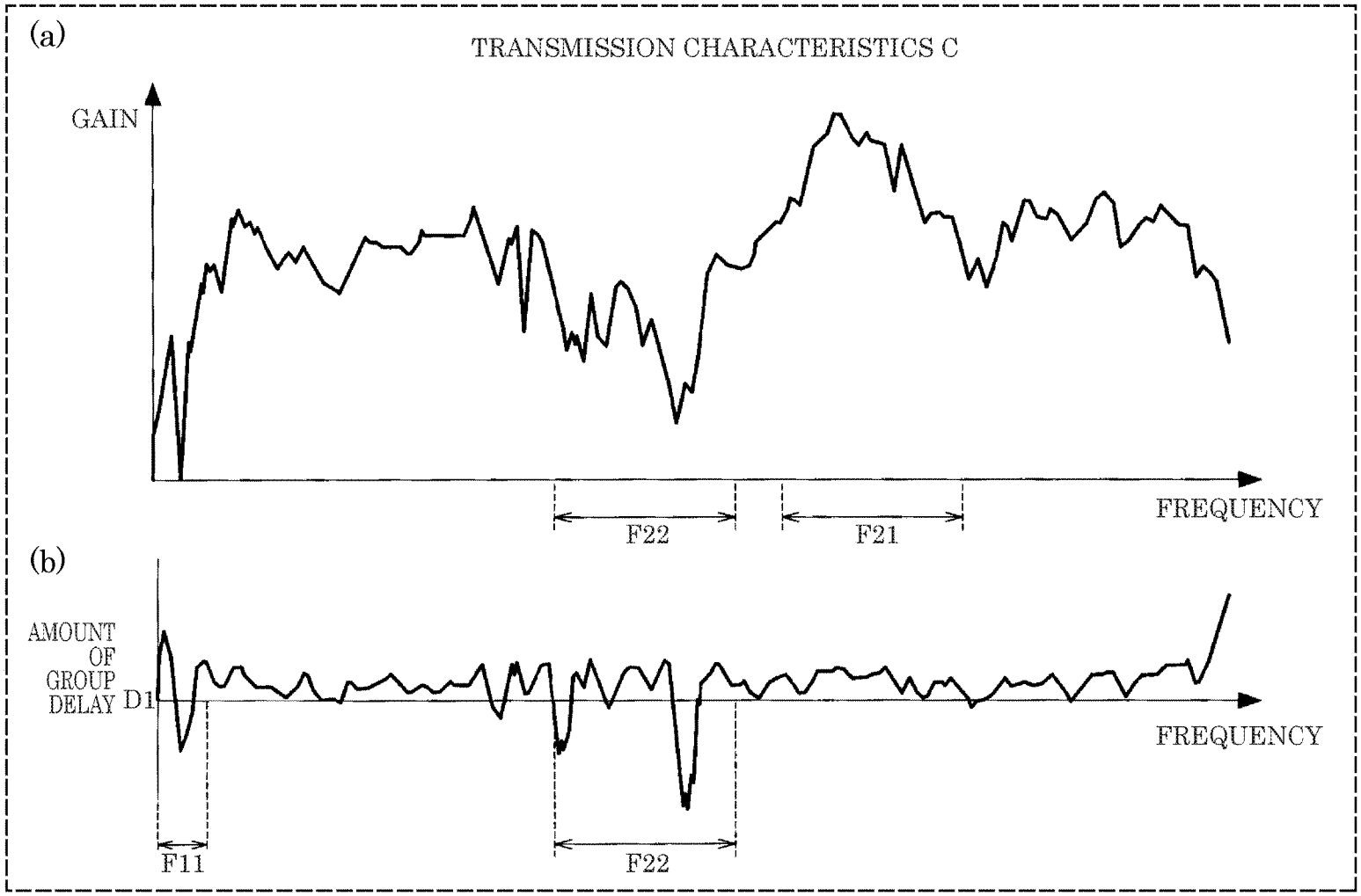
FIG. 4 shows a graph (a) showing the gain of transmission characteristics C according to Embodiment 1, and a graph (b) showing the amount of group delay of transmission characteristics C according to Embodiment 1.

Also, as shown in FIG. 4, in frequency band F1, there is frequency band F11 in which the gain of transmission characteristics C locally drops, and the amount of group delay of transmission characteristics C falls below threshold value D1. However, it is preferable that frequency band F11 is present within first noise frequency band F1 that is the frequency band of the first noise emitted by fan 22 and the first noise included in frequency band F11 is suppressed. Thus, parameter setter 137 sets update parameter μ for frequency bins 8 constituting frequency band F11 to a value greater than zero.

Data on each of peak band F21 and notch band F22 used by parameter setter 137 is set in advance based on transmission characteristics C^ set in correction filter 133*a*. Also, in this specification, where it is unnecessary to make a distinction between frequency bins 91, 92 and 93 within frequency band F2, they are referred to as frequency bins 9.

Here, if update parameter μ is a value greater than zero, the second term on the right side of Equation 1 given above equals a value greater than zero, and filter coefficient W(ω) is sequentially updated. If, on the other hand, update parameter μ is zero, the second term on the right side of Equation 1 given above equals zero, and filter coefficient W(ω) is not updated.

Accordingly, coefficient adjuster 135*a* executes the filter coefficient W (ω) update processing on frequency bins 8 constituting frequency band F1. Furthermore, coefficient adjuster 135*a* also executes the filter coefficient W (ω) update processing on frequency bins 91 constituting peak band F21 within frequency band F2.

On the other hand, coefficient adjuster 135*a* does not execute the filter coefficient W (ω) update processing on frequency bins 92 and 93 constituting a band other than peak band F21 within frequency band F2. That is, the filter coefficient W (ω) update processing is not executed on frequency bins 92 constituting notch band F22. Furthermore, in the present embodiment, the filter coefficient W (ω) update processing is not executed on frequency bins 93 that do not constitute notch band F22, either.

Figure 8:
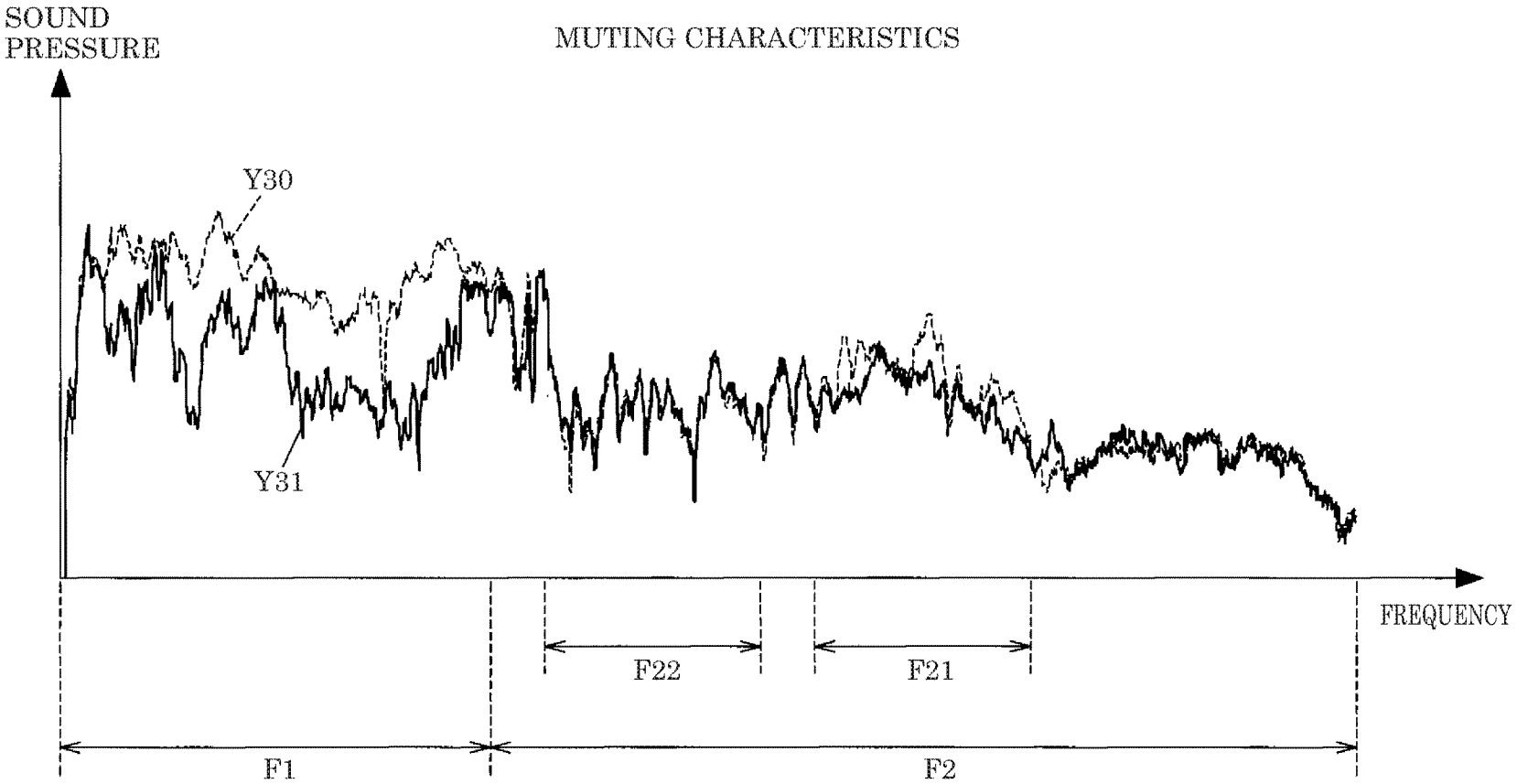
FIG. 8 is a graph showing muting characteristics obtained as a result of the signal processing device according to Embodiment 1 performing the processing.

FIG. 8 shows muting characteristics in which characteristics Y31 (solid line) indicate the sound pressure (amplitude) at the muting point when signal processing device 12 has executed the above-described processing shown in FIG. 7. Also, characteristics Y30 (broken line) indicate the sound pressure (amplitude) at the muting point when noise suppression processing was not performed. Thus, as indicated by characteristics Y31 shown in FIG. 8, the amplification in peak band F21 is suppressed, and no amplification and oscillation are produced in notch band F22. Accordingly, with signal processing device 12 according to the present embodiment, it is possible to obtain an excellent muting effect even when there are peak band F21 and notch band F22 in transmission characteristics C from speaker 113 to error microphone 112.

Also, coefficient adjuster 135*a* executes the filter coefficient W (ω) update processing only on frequency bins 91 in frequency band F2, and does not execute the filter coefficient W (ω) update processing on frequency bins 92 and 93. Accordingly, signal processing device 12 according to the present embodiment performs the filter coefficient W (ω) update processing only on a portion of the whole frequency band in which the canceling sound can be generated, and it is therefore possible to reduce the load on computation processing for computing filter coefficient W(ω).

Signal processing device 12 described above is used in combination with sound input/output device 11 including reference microphone 111 (first sound inputter), speaker (sound outputter) 113, and error microphone 112 (second sound inputter). Reference microphone 111 is provided within the space (the space within duct 21) through which the first noise emitted by fan 22 (noise source) propagates, and collects the first noise. Speaker 113 receives an input of the canceling signal and outputs, to the space, a canceling sound that cancels out the first noise. Error microphone 112 collects a combined sound of the first noise and the canceling sound in the space.

Signal processing device 12 includes canceling signal generator 136, coefficient updater 135, and parameter setter 137. Canceling signal generator 136 includes muting filter 136*a* in which filter coefficient W is set with respect to each of a plurality of frequency bins obtained by dividing a predetermined frequency band. Canceling signal generator 136 receives an input of noise signal X(t) generated based on the output of reference microphone 111, and outputs the canceling signal. Coefficient updater 135 calculates filter coefficient W with respect to each of the plurality of frequency bins based on the output of reference microphone 111, the output of error microphone 112 and update parameter μ. Parameter setter 137 sets update parameter μ with respect to each of the plurality of frequency bins. Update parameter μ is a parameter related to the magnitude of the amount of correction for filter coefficient W in processing of repeatedly calculating filter coefficient W.

Then, parameter setter 137 sets update parameter μ such that filter coefficient W can be corrected with respect to frequency bins 8 (first frequency bin) among the plurality of frequency bins, frequency bins 8 corresponding to a first noise frequency band that is the frequency band of the first noise. In addition, parameter setter 137 also sets update parameter μ such that filter coefficient W can also be corrected with respect to frequency bins 91 (second frequency bin) among the plurality of frequency bins, frequency bins 91 corresponding to a second noise frequency band that is the frequency band of a second noise that is different from the first noise. Furthermore, parameter setter 137 sets update parameter μ such that filter coefficient W is not corrected with respect to frequency bins 92 (third frequency bin) constituting notch band F22 in which transmission characteristics C in the acoustic path extending from speaker 113 to error microphone 112 drop among frequency bins 9 of the plurality of frequency bins, frequency bins 9 corresponding to neither the first noise frequency band nor the second noise frequency band.

Accordingly, with signal processing device 12 according to the present embodiment, it is possible to reduce the load on computation processing for computing filter coefficient W(ω). Furthermore, with signal processing device 12 according to the present embodiment, it is possible to obtain an excellent muting effect even when there are peak band F21 and notch band F22 in transmission characteristics C from speaker 113 to error microphone 112.

Embodiment 2

Figure 9:
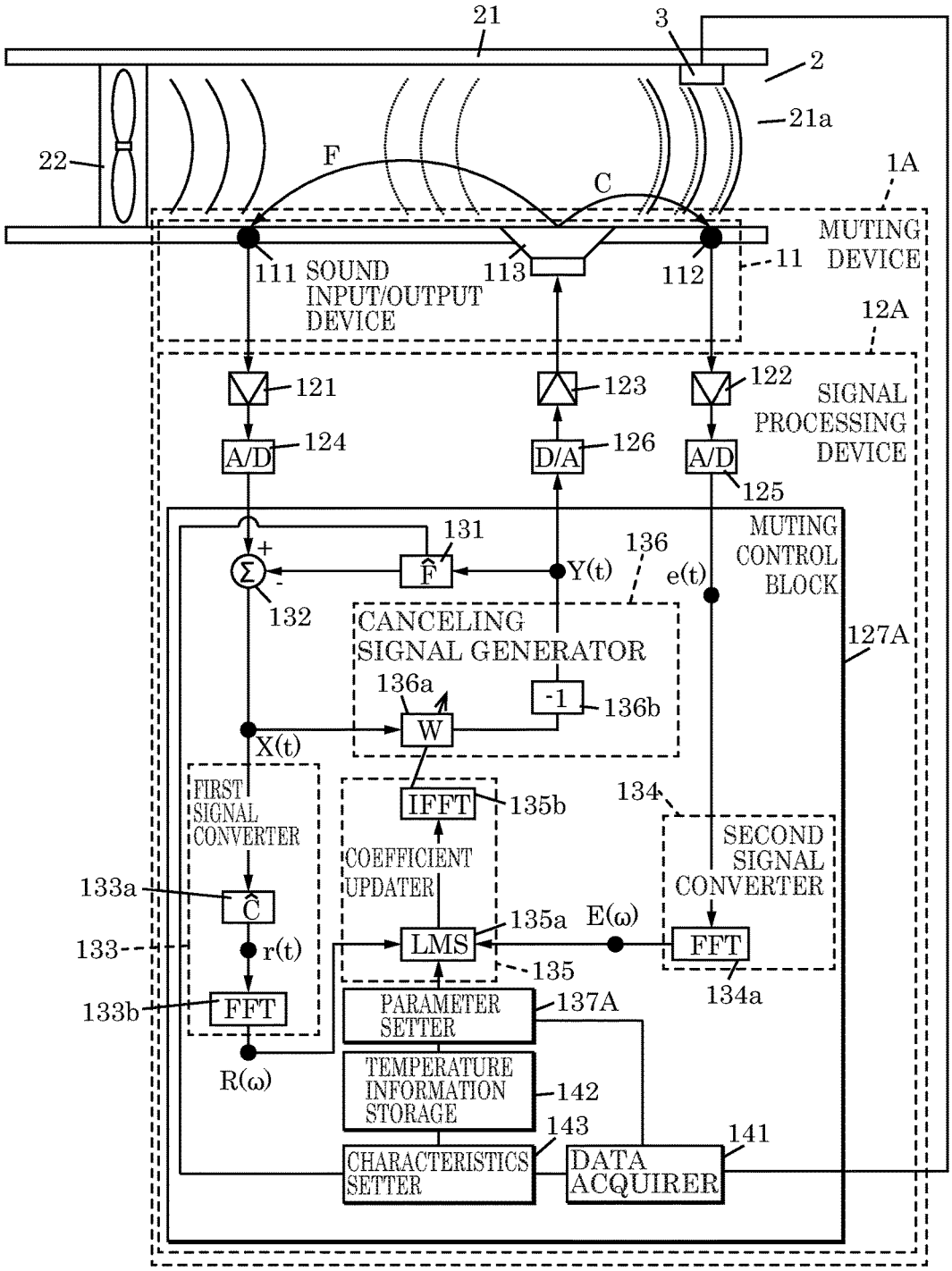
FIG. 9 is a block diagram showing a configuration according to Embodiment 2.

A configuration of muting device 1A (active noise control device) according to the present embodiment is shown in FIG. 9. The structural elements of muting device 1A that are the same as those of muting device 1 according to Embodiment 1 are given the same reference numerals as those of muting device 1 according to Embodiment 1, and a description thereof is omitted here.

Muting device 1A includes temperature sensor 3 within duct 21. Temperature sensor 3 measures the temperature within duct 21 and outputs the result of measurement. Furthermore, signal processing device 12A of muting device 1A includes muting control block 127A, and muting control block 127A further includes data acquirer 141, temperature information storage 142, and characteristics setter 143.

Figure 10:
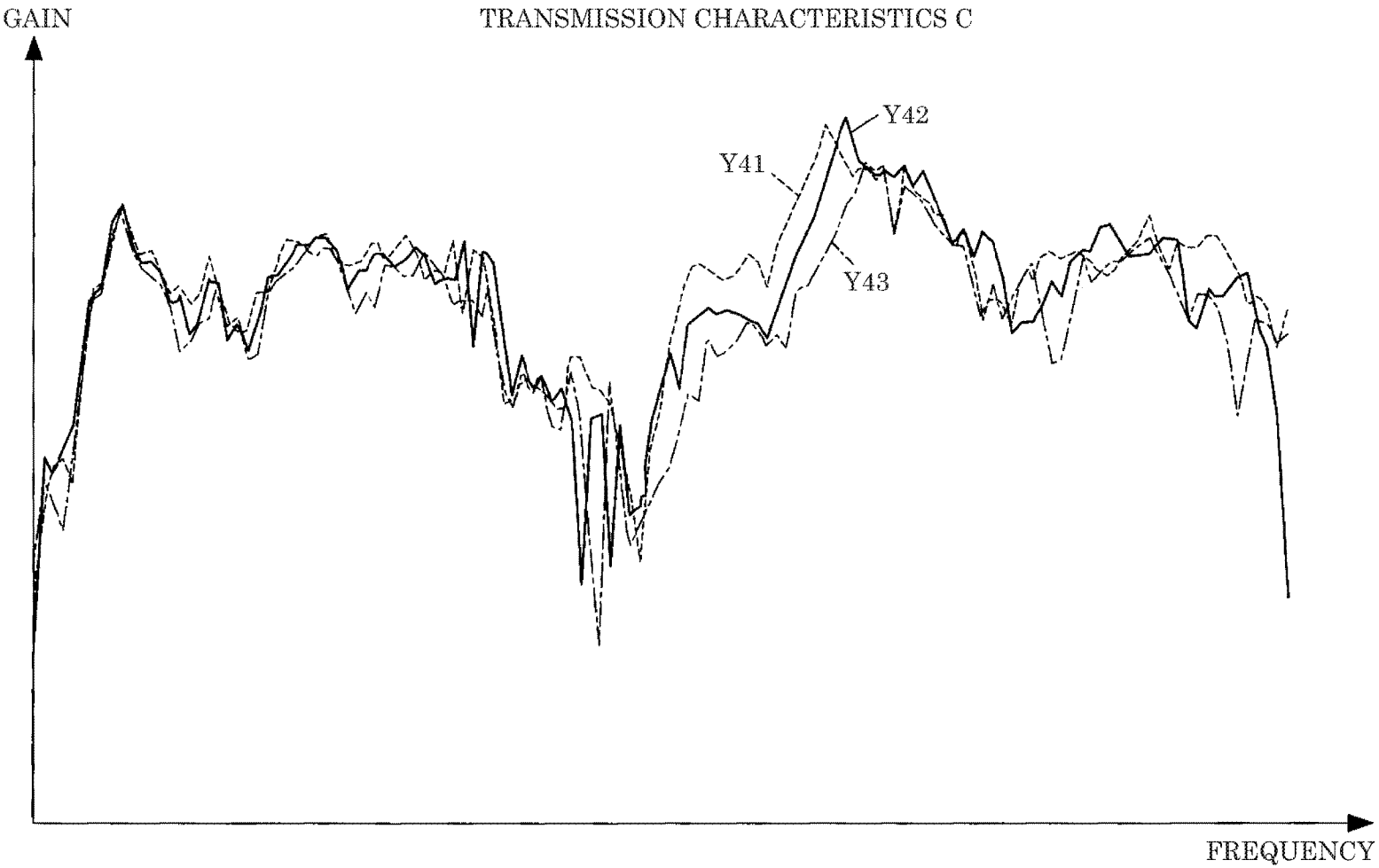
FIG. 10 is a graph showing temperature variations in transmission characteristics C according to Embodiment 2.

In general, transmission characteristics C and transmission characteristics F vary according to the temperature within duct 21. FIG. 10 shows an example of transmission characteristics C at each temperature within duct 21, and the range of variation of transmission characteristics C due to temperature change is greater as the frequency becomes higher. Likewise, transmission characteristics F also vary according to the temperature within duct 21. In FIG. 10, characteristics Y41, Y42 and Y43 are shown in ascending order of the temperature within duct 21.

Accordingly, muting device 1A performs the following processing based on the result of measurement of the temperature within duct 21 by temperature sensor 3.

First, data acquirer 141 acquires, from temperature sensor 3, the result of measurement (temperature data) of the temperature within duct 21 and outputs the temperature data to parameter setter 137A and characteristics setter 143.

Temperature information storage 142 stores therein data on transmission characteristics C corresponding to each of a plurality of temperatures, and data on transmission characteristics F corresponding to each of a plurality of temperatures. Then, characteristics setter 143 reads, from temperature information storage 142, the data on transmission characteristics C and the data on transmission characteristics F corresponding to the temperature data. Characteristics setter 143 sets the data on transmission characteristics C read from temperature information storage 142 in correction filter 133*a*, and sets the data on transmission characteristics F read from temperature information storage 142 in howling cancel filter 131. Accordingly, in correction filter 133*a*, transmission characteristics C corresponding to the temperature within duct 21 are set, and in howling cancel filter 131, transmission characteristics F corresponding to the temperature within duct 21 are set.

Accordingly, even if transmission characteristics C and F vary due to temperature change, transmission characteristics Cˆ in correction filter 133*a* and transmission characteristics Fˆ in howling cancel filter 131 are appropriately set. That is, the correction processing performed by correction filter 133*a* and the howling cancel processing performed by howling cancel filter 131 can suppress the influence of temperature change.

Furthermore, parameter setter 137A reads, from temperature information storage 142, the data on transmission characteristics C corresponding to the temperature data. Parameter setter 137A references to the data on transmission characteristics C read from temperature information storage 142 and specifies peak band F21. To be specific, parameter setter 137A can specify peak band F21 by performing a local maximum method, differential computation and the like, the local maximum method being a method for searching for a local maximum point in transmission characteristics C in frequency band F2. Parameter setter 137A sets update parameter μ to a value greater than zero with respect to frequency bins 91 constituting peak band F21.

Accordingly, parameter setter 137A can specify peak band F21 in frequency band F2 with high accuracy even if transmission characteristics C vary due to temperature change, and can appropriately select frequency bins 91.

Furthermore, the data on transmission characteristics C stored in temperature information storage 142 includes information regarding the group delay characteristics of transmission characteristics C. Accordingly, parameter setter 137A can specify notch band F22 by referencing to the data on transmission characteristics C read from temperature information storage 142. To be specific, parameter setter 137A sets, in frequency band F2, a frequency band in which the amount of group delay falls below threshold value D1 as notch band F22 (see (b) in FIG. 4). Parameter setter 137A consistently sets update parameter μ to zero with respect to frequency bins 92 constituting notch band F22.

Accordingly, parameter setter 137A can specify notch band F22 in frequency band F2 with high accuracy even if transmission characteristics C vary due to temperature change, and can appropriately select frequency bins 92.

As described above, it is preferable that signal processing device 12A includes data acquirer 141 that acquires temperature data on temperature in the space (the space within duct 21). Then, parameter setter 137A selects frequency bins 91 (second frequency bin) and frequency bins 92 (third frequency bin) according to the temperature within the space.

Accordingly, with signal processing device 12A, it is possible to obtain a further excellent muting effect even when transmission characteristics C vary due to temperature change.

Furthermore, in the present embodiment, parameter setter 137A sets update parameter μ to zero with respect to frequency bins 93 that do not constitute notch band F22 within frequency band F2. However, update parameter μ for frequency bins 93 may be set to a value greater than zero.

Embodiment 3

Figure 11:
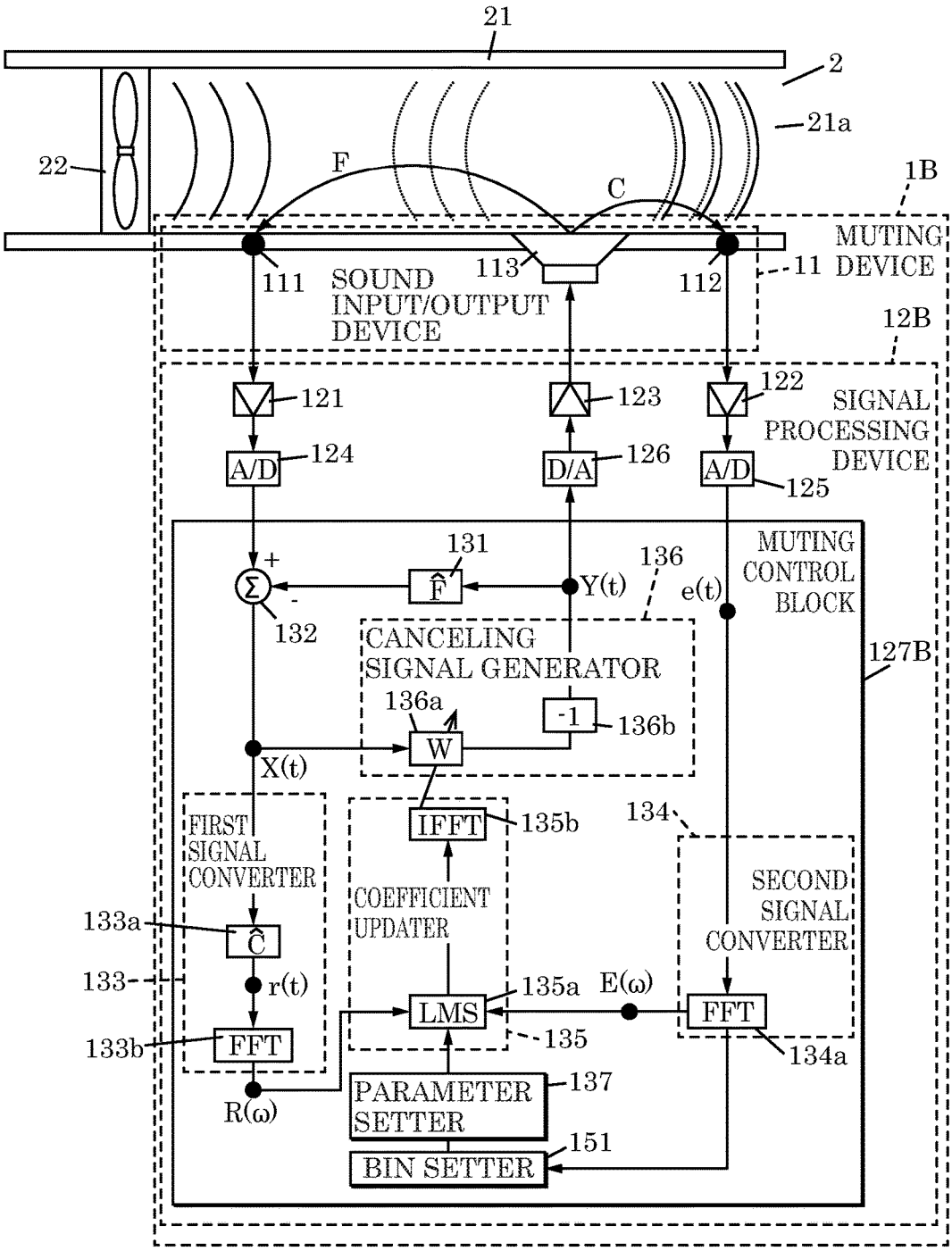
FIG. 11 is a block diagram showing a configuration according to Embodiment 3.

A configuration of muting device 1B (active noise control device) according to the present embodiment is shown in FIG. 11. The structural elements of muting device 1B that are the same as those of muting device 1 according to Embodiment 1 are given the same reference numerals as those of muting device 1 according to Embodiment 1, and a description thereof is omitted here.

Signal processing device 12B of muting device 1B includes muting control block 127B, and muting control block 127B includes bin setter 151. Bin setter 151 sets each of all frequency bins 9 in frequency band F2 as any one of frequency bins 91, frequency bins 92 and frequency bins 93.

To be specific, bin setter 151 issues an instruction to parameter setter 137 so as to perform the partial update processing and the full update processing described above. The partial update processing is executed by parameter setter 137 setting update parameter μ to zero with respect to all frequency bins 9 in frequency band F2. The full update processing is executed by parameter setter 137 setting update parameter μ to a value greater than zero with respect to all frequency bins 9 in frequency band F2.

Then, bin setter 151 compares filter coefficient W(ω) obtained when the partial update processing has been performed and filter coefficient W(ω) obtained when the full update processing has been performed. Bin setter 151 sets, as peak band F21 (see FIG. 5), a range in frequency band F2, the range being where filter coefficient W(ω) obtained when the partial update processing has been performed is greater than filter coefficient W(ω) obtained when the full update processing has been performed. Bin setter 151 sets update parameter μ to a value greater than zero with respect to frequency bins 91 constituting peak band F21. For a peak band, a minimum bandwidth is determined in advance, and only if the range where filter coefficient W(ω) obtained when the partial update processing has been performed is greater than filter coefficient W(ω) obtained when the full update processing has been performed continues for a length corresponding to the minimum bandwidth or more, bin setter 151 recognizes it as a peak band.

Furthermore, bin setter 151 causes a reference sound having known frequency characteristics to be output from speaker 113. Then, bin setter 151 infers transmission characteristics C based on the frequency characteristics of the reference sound collected by error microphone 112. Bin setter 151 derives the group delay characteristics of transmission characteristics C and sets, as notch band F22 (see (b) in FIG. 4), a frequency band in which the amount of group delay falls below threshold value D1. Bin setter 151 consistently sets update parameter μ to zero with respect to frequency bins 92 constituting notch band F22.

Accordingly, because bin setter 151 can recognize peak band F21 and notch band F22 based on the actual characteristics of transmission characteristics C, frequency bins 91, 92 can be set based on the actual characteristics of transmission characteristics C, and it is therefore possible to obtain a further excellent muting effect.

As described above, it is preferable that signal processing device 12B includes bin setter 151 that sets frequency bins 91 (second frequency bin) and frequency bins 92 (third frequency bin). Bin setter 151 extracts, from a frequency band other than first noise frequency band F1, frequency bins in which the gain of filter coefficient W when update parameter μ with which filter coefficient W cannot be corrected is set is greater than the gain of filter coefficient W when update parameter μ with which filter coefficient W can be corrected is set. Then, bin setter 151 sets the extracted frequency bins as frequency bins 91 (second frequency bin). Furthermore, bin setter 151 extracts, from a frequency band other than first noise frequency band F1, frequency bins in which the amount of group delay of transmission characteristics C in the acoustic path extending from speaker 113 to error microphone 112 falls below threshold value D1, and sets the extracted frequency bins as frequency bins 92 (third frequency bin).

Accordingly, with signal processing device 12B, peak band F21 and notch band F22 can be recognized by bin setter 151 with high accuracy, and it is therefore possible to obtain a further excellent muting effect.

In the embodiments given above, a computer that constitutes signal processing device 12, 12A or 12B includes a processor that runs according to a program and an interface as main hardware components. This type of processor includes a digital signal processor (DSP), a central processing unit (CPU), a micro-processing unit (MPU), and the like. The processor can be any type of processor as long as the functionality of signal processing device 12, 12A or 12B described above can be implemented by executing a program.

The program may be provided on computer-readable read-only memories (ROMs), may be stored in advance in recording media such as an optical disk, or may be supplied to recording media via wide area communication networks including the Internet and the like.

That is, the program causes a computer to function as signal processing device 12, 12A or 12B.

Also, range hood device 2 includes hollow duct 21, fan 22, reference microphone 111, speaker 113, error microphone 112, and signal processing device 12 (or 12A or 12B). Hollow duct 21 corresponds to an air flow path, reference microphone 111 corresponds to a first sound inputter, speaker 113 corresponds to a sound outputter, and error microphone 112 corresponds to a second sound inputter. Then, error microphone 112, speaker 113, and reference microphone 111 are disposed in this order in a direction from one end to the other end of duct 21. Fan 22 generates a flow of air flowing from one end to another end of duct 21. Reference microphone 111 is provided within duct 21 and collects a first noise emitted by fan 22. Speaker 113 receives an input of a canceling signal and outputs, into duct 21, the canceling sound that cancels out the first noise. Error microphone 112 collects, within duct 21, a combined sound of the first noise and the canceling sound.

Accordingly, the program that causes a computer to function as signal processing device 12, 12A or 12B can also produce the same advantageous effects as those described above. That is, with the program, it is possible to reduce the load on computation processing for computing filter coefficient W(ω). Furthermore, with the program, it is possible to obtain an excellent muting effect even when there are peak band F21 and notch band F22 in transmission characteristics C from speaker 113 to error microphone 112.

Also, with range hood device 2 incorporating signal processing device 12, 12A or 12B, it is also possible to reduce the load on computation processing for computing filter coefficient W(ω). Furthermore, with range hood device 2, it is possible to obtain an excellent muting effect even when there are peak band F21 and notch band F22 in transmission characteristics C from speaker 113 to error microphone 112.

Figure 12:
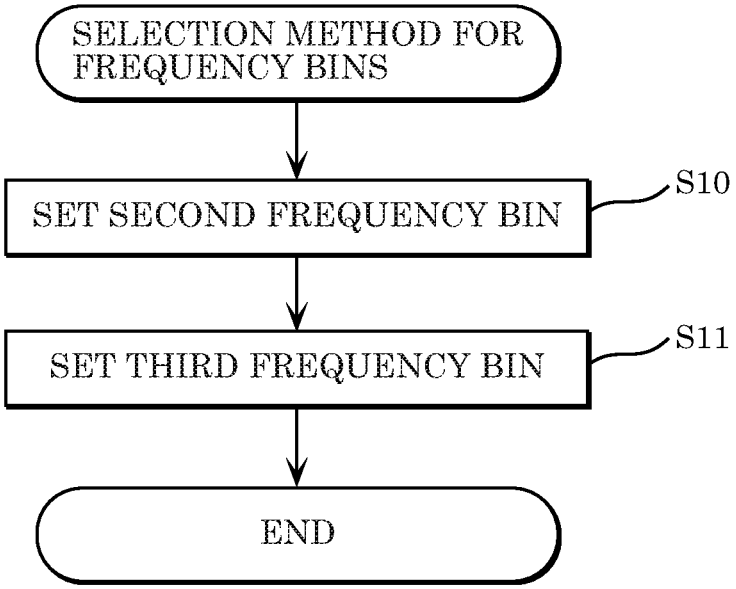
FIG. 12 is a flowchart illustrating a selection method for frequency bins.

Also, a selection method for frequency bins in signal processing device 12, 12A or 12B according to the embodiments described above has the following features as shown in the flowchart of FIG. 12. First, among frequency bins that do not correspond to first noise frequency band F1 that is the frequency band of the first noise emitted from fan 22 (noise source), frequency bins in which the gain of filter coefficient W when update parameter μ with which filter coefficient W cannot be corrected is set is greater than the gain of filter coefficient W when update parameter μ with which filter coefficient W can be corrected is set are set as frequency bins 91 (second frequency bin) (S10). Furthermore, among frequency bins that do not correspond to first noise frequency band F1, frequency bins in which the amount of group delay of transmission characteristics C in the acoustic path extending from speaker 113 to error microphone 112 falls below threshold value D1 are set as frequency bins 92 (third frequency bin) (S11). The order in which step S10 and step S11 are performed may be reversed.

Accordingly, signal processing device 12, 12A or 12B can set peak band F21 and notch band F22 with high accuracy, and it is therefore possible to obtain an excellent muting effect.

Also, a device other than range hood device 2 may include muting device 1 according to the embodiments described above.

The embodiments described above are examples of the present invention. For this reason, the present invention is not limited to the embodiments given above, and other than the embodiments given herein, various modifications are of course possible according to the design and the like without departing from the scope of the technical idea of the present invention.

The invention claimed is:

1. A signal processing device that is used in combination with a sound input/output device including a first sound inputter that is provided in a space through which a first noise emitted from a noise source propagates and that collects the first noise, a sound outputter that receives an input of a canceling signal and that outputs, to the space, a canceling sound that cancels out the first noise, and a second sound inputter that collects, in the space, a combined sound of the first noise and the canceling sound, the signal processing device comprising:

a canceling signal generator including a muting filter in which a filter coefficient is set for each of a plurality of frequency bins obtained by dividing a predetermined frequency band, the canceling signal generator receiving an input of a noise signal generated based on an output of the first sound inputter and outputting the canceling signal;

a coefficient updater that calculates the filter coefficient for each of the plurality of frequency bins based on an output of the first sound inputter, an output of the second sound inputter, and update parameters that are related to a magnitude of an amount of correction for the filter coefficient in processing of repeatedly calculating the filter coefficient; and a parameter setter that sets the update parameter for each of the plurality of frequency bins, wherein the parameter setter sets the update parameter such that the filter coefficient is corrected for a first frequency bin and a second frequency bin among the plurality of frequency bins, the first frequency bin belonging to a frequency band of the first noise, and the second frequency bin belonging to a frequency band of a second noise that is different from the first noise, and the parameter setter sets the update parameter such that the filter coefficient is not corrected for a third frequency bin outside an entire bandwidth of the first noise and an entire bandwidth of the second noise, the third frequency bin constituting a notch band in which transmission characteristics in an acoustic path extending from the sound outputter to the second sound inputter drop.

2. The signal processing device according to claim 1, further comprising a data acquirer that acquires temperature data on temperature in the space, wherein the parameter setter selects the second frequency bin and the third frequency bin according to temperature in the space.

3. The signal processing device according to claim 1, further comprising a bin setter that sets the second frequency bin and the third frequency bin, wherein the bin setter extracts, from a frequency band other than the frequency band of the first noise, a frequency bin in which a gain of the filter coefficient when the update parameter with which the filter coefficient is not corrected is set is greater than a gain of the filter coefficient when the update parameter with which the filter coefficient is corrected is set, and sets a first extracted frequency bin as the second frequency bin, and the bin setter extracts, from the frequency band other than the frequency band of the first noise, a frequency bin in which an amount of group delay of transmission characteristics in the acoustic path extending from the sound outputter to the second sound inputter falls below a threshold value, and sets a second extracted frequency bin as the third frequency bin.

4. The signal processing device according to claim 1, wherein the parameter setter sets, as the second frequency bin, a frequency bin among frequency bins that do not correspond to the entire bandwidth of the first noise emitted from the noise source, the frequency bin being where a gain of the filter coefficient when the update parameter with which the filter coefficient is not corrected is set is greater than a gain of the filter coefficient when the update parameter with which the filter coefficient is corrected is set; and wherein the parameter setter sets, as the third frequency bin, a frequency bin among the frequency bins that do not correspond to the entire bandwidth of the first noise, the frequency bin being where an amount of group delay of transmission characteristics in the acoustic path extending from the sound outputter to the second sound inputter falls below a threshold value.

5. A range hood device comprising:

an air flow path that is hollow;

a fan that generates a flow of air flowing from one end of the air flow path to another end of the air flow path;

a first sound inputter that is provided within the air flow path and that collects a first noise emitted by the fan;

a sound outputter that receives an input of a canceling signal and outputs, into the air flow path, a canceling sound that cancels out the first noise;

a second sound inputter that collects, within the air flow path, a combined sound of the first noise and the canceling sound; and the signal processing device according to claim 1, wherein the second sound inputter, the sound outputter, and the first sound inputter are disposed in this order in a direction from the one end of the air flow path to the other end of the air flow path.

6. A non-transitory computer-readable recording medium having recorded thereon a program for causing a computer to function as the signal processing device according to claim 1.

7. A signal processing method for a device that is used in combination with a sound input/output device including a first sound inputter that is provided in a space through which a first noise emitted from a noise source propagates and that collects the first noise, a sound outputter that receives an input of a canceling signal and that outputs, to the space, a canceling sound that cancels out the first noise, and a second sound inputter that collects, in the space, a combined sound of the first noise and the canceling sound, the signal processing method comprising:

at a canceling signal generator including a muting filter in which a filter coefficient is set for each of a plurality of frequency bins obtained by dividing a predetermined frequency band, receiving an input of a noise signal generated based on an output of the first sound inputter and outputting the canceling signal;

at a coefficient updater, calculating the filter coefficient for each of the plurality of frequency bins based on an output of the first sound inputter, an output of the second sound inputter, and update parameters that are related to a magnitude of an amount of correction for the filter coefficient in processing of repeatedly calculating the filter coefficient; and at a parameter setter, setting the update parameter for each of the plurality of frequency bins, wherein the parameter setter sets the update parameter such that the filter coefficient is corrected for a first frequency bin and a second frequency bin among the plurality of frequency bins, the first frequency bin belonging to a frequency band of the first noise, and the second frequency bin belonging to a frequency band of a second noise that is different from the first noise, and the parameter setter sets the update parameter such that the filter coefficient is not corrected for a third frequency bin outside an entire bandwidth of the first noise and an entire bandwidth of the second noise, the third frequency bin constituting a notch band in which transmission characteristics in an acoustic path extending from the sound outputter to the second sound inputter drop.

8. The selection method of claim 7, comprising:

at the parameter setter, setting, as the second frequency bin, a frequency bin among frequency bins that do not correspond to the entire bandwidth of the first noise emitted from the noise source, the frequency bin being where a gain of the filter coefficient when the update parameter with which the filter coefficient is not corrected is set is greater than a gain of the filter coefficient when the update parameter with which the filter coefficient is corrected is set; and at the parameter setter, setting, as the third frequency bin, a frequency bin among the frequency bins that do not correspond to the entire bandwidth of the first noise, the frequency bin being where an amount of group delay of transmission characteristics in the acoustic path extending from the sound outputter to the second sound inputter falls below a threshold value.

* * * * *